US005605266A

United States Patent [19]

Müssig et al.

[11] Patent Number: 5,605,266

[45] Date of Patent: Feb. 25, 1997

[54] DEVICE FOR ALIGNING MATERIAL WEBS

[75] Inventors: Karl Müssig; Martin Schnaus, both of Bad Königshofen; Roland Behr, Grossbardorf, all of Germany

[73] Assignee: Texpa Arbter Maschinenbaugesellschaft mbH, Saale, Germany

[21] Appl. No.: 441,815

[22] Filed: May 16, 1995

[30] Foreign Application Priority Data

May 25, 1994 [DE] Germany ..... 44 18 241.4

[51] Int. Cl.[6] ..... B65H 23/18; B26D 7/14; B26D 5/20; D06C 13/06

[52] U.S. Cl. ..... 226/39; 83/175; 83/268; 26/7; 26/12

[58] Field of Search ..... 226/39, 38; 83/175, 83/18, 268; 26/7, 11, 12

[56] References Cited

U.S. PATENT DOCUMENTS

| | | | |
|---|---|---|---|
| 4,034,634 | 7/1977 | Arbter | 83/175 X |
| 4,609,182 | 9/1986 | Freermann | 83/175 X |
| 4,771,928 | 9/1988 | Okada | 83/175 X |
| 4,926,725 | 5/1990 | Helgesson | 83/175 X |
| 4,949,609 | 8/1990 | Sohtome et al. | 83/175 |

FOREIGN PATENT DOCUMENTS

| | | | |
|---|---|---|---|
| 2544410 | 4/1977 | Germany | B26D 1/02 |
| 2544410C3 | 11/1979 | Germany . | |
| 2147237 | 5/1985 | United Kingdom . | |
| 86/00349 | 1/1986 | WIPO . | |

*Primary Examiner*—Michael R. Mansen
*Attorney, Agent, or Firm*—Laff, Whitesel, Conte & Saret, Ltd.

[57] ABSTRACT

A device for aligning material webs which in a longitudinal direction have alternating regions of differing thickness, has a top and a bottom aligning rail, which are disposed substantially at right angles to the material web and opposite one another with slight clearance. The top aligning rail has a row of aligning elements which are disposed in a longitudinal direction of the aligning rail. They are supported so as to be movable substantially at right angles to the plane of the material web and may be brought to rest on the bottom aligning rail with the material web for alignment lying in between. The aligning elements are supported in a substantially freely movable manner in the top aligning rail such that they may be brought under the action of gravity to rest on the material web. The aligning elements after being brought to rest on the material web are releasably fixable in the top aligning rail.

10 Claims, 4 Drawing Sheets

DEVICE FOR ALIGNING MATERIAL WEBS

BACKGROUND

The invention relates to a device for aligning material webs.

Such devices are used whenever material webs are required to be precisely positioned and aligned for a subsequent processing stage, generally cutting into individual pieces of material.

Material webs of the type presently under discussion have regions of differing thickness alternating in a longitudinal direction. For instance, in the case of terry toweling material, there are usually pile-free sections provided at regular intervals and extending at right angles to the longitudinal direction of the web, the distance between said pile-free sections corresponding substantially to the length of the finished product to be produced, e.g. a hand towel. Since cutting of the continuous material web is effected in the region of said pile-free sections, the material web while being conveyed has to be positioned and aligned by a suitable installation in such a way that, on the one hand, the pile-free section is precisely positioned in relation to a cutting or separating device and, on the other hand, the material web at least in said region is aligned in such a way that distortions involving a curvilinear and/or oblique-angled course of the woven, in particular of the weft yarns and the pile-free sections, are reliably avoided at least in said region.

From German patent specification DE 25 44 410 C3, a device for aligning and cutting material webs of differing thickness in a longitudinal direction is known, which comprises a top aligning rail having a row of aligning elements, which are disposed alongside one another substantially over the entire width of the material web and may be brought to rest on a table acting as an abutment, the material web which is to be aligned lying between the aligning elements and the table. Said aligning elements are supported in the top aligning rail so as to be movable under the action of a spring in a direction at right angles to the material web. At their bottom end directed towards the material web, the aligning elements have a wedge-shaped shoe which is pressed by the resilient restoring force of the spring onto the material web in the region of the pile-free sections. Because of the tensile forces exerted by a conveying device upon the material web, the material web in the case of the known device is pulled relative to the aligning device until the start of the raised pile region "pushes against" the edge of the shoes of the aligning elements. Since the tensile forces are exerted uniformly over the entire width of the material web, the result is that, over the entire width of the material web, the start of the raised pile region comes to rest against the aligning elements forming the aligning rail, thereby enabling a precise alignment of the material web in said region.

The main drawback of said known device is that, because of the flexible, spring-loaded mounting of the aligning elements, even with relatively low tensile forces upon the material web it is impossible reliably to prevent a lifting of the aligning elements caused by the raised pile region moving under the shoes of the aligning elements. This then leads to the pile region slipping through the aligning device; reliable positioning is no longer possible. A further drawback of said known device is that, especially if the material web has regions of differing thickness also in transverse direction, e.g. edge regions with no pile, hem regions etc., the contact pressure of the individual aligning elements is not uniform over the entire width of the material web. Because of the non-uniform retaining forces caused thereby, an undesirable slipping through of portions of the material web under the aligning device cannot be reliably ruled out.

SUMMARY OF THE INVENTION

Proceeding from said background art, the object of the present invention is to provide a device for aligning material webs which have regions of differing thickness alternating in a longitudinal direction, said device in a simple and reliable manner enabling a precise alignment of the material webs.

According to the invention, the device for aligning material webs comprises a top and a bottom aligning rail, said two aligning rails being disposed substantially at right angles to the material web and lying opposite one another with slight clearance. In other words, the two aligning rails form a gap through which the material web passes.

The top aligning rail in a known manner has a row of aligning elements disposed in a longitudinal direction of the aligning rail. Said aligning elements are supported in the top aligning rail so as to be movable, i.e. displaceable, substantially at right angles to the plane of the material web and may be brought to rest on the bottom aligning rail, with the material web to be aligned lying between the two rails. Unlike the aligning elements known from DE 25 44 410 C3, however, the aligning elements according to the invention are supported in a substantially freely movable manner such that they may be brought to rest on the material web under the force of gravity. In other words, according to the present invention there is no active pressing of the aligning elements by means of springs, pressure forces or the like; it is exclusively as a result of their dead weight or mass that the aligning elements come to rest on the material web lying on the bottom aligning rail. Since the masses of all of the substantially identically constructed aligning elements are identical, the result is a totally uniform contact pressure of the aligning elements on the material web over the entire width of the material web. In addition, by said means the aligning elements are in an extremely simple manner adapted to the transverse profile of the material web to be aligned if, for example, said material web has alternating regions of differing thickness, hems or the like in a transverse direction.

Once the aligning elements in the above-described manner have been brought to rest on the material web in a region of reduced thickness, e.g. in the case of terry toweling material, in a pile-free section, according to the invention a releasable fixing of the aligning elements in the top aligning rail is effected. The result of said fixing is that, while the contact pressure on the material web produced solely by the mass of the aligning elements is maintained, the aligning elements are simply and reliably locked against lifting off the material web when a region of greater thickness, e.g. a pile region, comes to rest against the aligning elements. An undesirable slipping through of the material web under the aligning elements is therefore reliably prevented.

According to an embodiment of the invention, the aligning elements each comprise a shaft which is guided with at least slight, in particular radial play in a recess of a complementary shape in the top aligning rail. At their bottom end, the aligning elements have an aligning foot which may be brought to rest on the material web.

According to a further embodiment of the invention, the shaft of the aligning elements is substantially circular-cylindrical and has an at least slightly smaller diameter than the likewise cylindrical recess in the top aligning rail. While providing efficient axial guidance of the aligning elements, said embodiment of the invention is also simple and easy to manufacture.

According to a further embodiment of the invention, the length of the shaft of the aligning elements is greater than the height of the top aligning rail. In said embodiment, the recess for receiving the aligning elements fully penetrates the top aligning rail, i.e. the recess is open towards the top and bottom. The shaft of the aligning elements projects through the top recess of the top aligning rail out of said top aligning rail and is prevented from falling out in a downward direction by a locking element, e.g. a Seeger circlip ring, disposed at the top end of the shaft.

According to an embodiment of the invention, the aligning foot of the aligning element has a supporting surface for resting on the material web and an aligning edge and/or aligning surface for resting against a region of greater thickness of the material web, in particular the start of the pile region of terry toweling material.

Fixing of the aligning elements in the top aligning rail after they have been brought to rest on the material web may in principle be effected in any desired manner. It may in particular be effected in a keyed manner, e.g. in the manner of a mechanical gripping from behind, or force-lockingly in the manner of a clamping. In an extremely simple manner clamping may be effected, for example, by fixing each aligning element by means of a binding screw. A mechanical clamping by means of eccentric elements or the like is also possible without departing from the framework of the present invention. Equally, in basically any desired manner it is possible for each aligning element to be fixed individually or for all of the aligning elements to be fixed by means of a common clamping device.

According to a particularly preferred embodiment of the invention, clamping of the aligning elements is effected pneumatically or hydraulically. For said purpose, the device according to the invention preferably comprises a channel, which extends substantially over the entire width of the top aligning rail, may be acted upon by pneumatic pressure, has openings towards the guide recesses of the aligning elements and is provided with at least one pneumatically operable clamping element, which may be brought through the openings to rest against the guide shafts of the aligning elements. As a clamping element it is possible to use, for example, a rubber-elastic diaphragm which seals off the channel to the guide recesses for the aligning elements and when acted upon by pressure is pressed in a force- or friction-locking manner against the shafts of the aligning elements.

According to a preferred embodiment of the invention, as a clamping element simple use is made of a substantially airtight tube which is disposed, in the simplest case laid, in the channel over its entire length and may be acted upon by pressure reversibly by means of a valve. When the pressure builds up, the tube wall, in the manner described above for the diaphragm, is pressed against the guide shafts of the aligning elements and locks the aligning elements; upon reduction of the pressure, said fixing is released.

For precise positioning and, in particular, lifting of the aligning elements from the material web, the top aligning rail is provided with means of effecting guidance and positioning relative to the material web. Said means preferably comprise hydraulic or pneumatic linear guides, in the simplest manner, therefore, pneumatic cylinders. Said two pneumatic cylinders are disposed on each of the two axial ends of the top aligning rail. A corresponding guiding and positioning device may additionally be provided for the bottom aligning rail.

An advantage of the device according to the invention having means of effecting guidance and positioning of at least the top aligning rail is that, if, for example, the pile-free section incorporates steps in a longitudinal direction as a result of borderings or the like, the aligning elements may provisionally be brought to rest in the deepest region of the section, in which case at the same time the profile of the material web in a transverse direction is simulated, and then, when the material web is conveyed further in a longitudinal direction, a lifting of the top aligning rail with the fixed aligning elements over the raised bordering region may be effected without the predetermined position of the aligning elements being altered. Once the bordering region has been drawn through under the aligning elements, a depositing of the top aligning rail with the positioned aligning elements onto the pile-free section is effected, after which the device is then ready for final positioning of the material web. As a result, there is no undesirable pushing of the aligning device against the step in the region of the section. Furthermore, said guiding and positioning means make it possible to achieve easy adaptation of the device to wovens of different thickness.

BRIEF DESCRIPTION OF THE DRAWINGS

There follows a detailed description of the invention with reference to drawings which illustrate one embodiment only. The drawings show.

DETAILED DESCRIPTION OF THE PREFERRED EMBODIMENT

Figure 1:
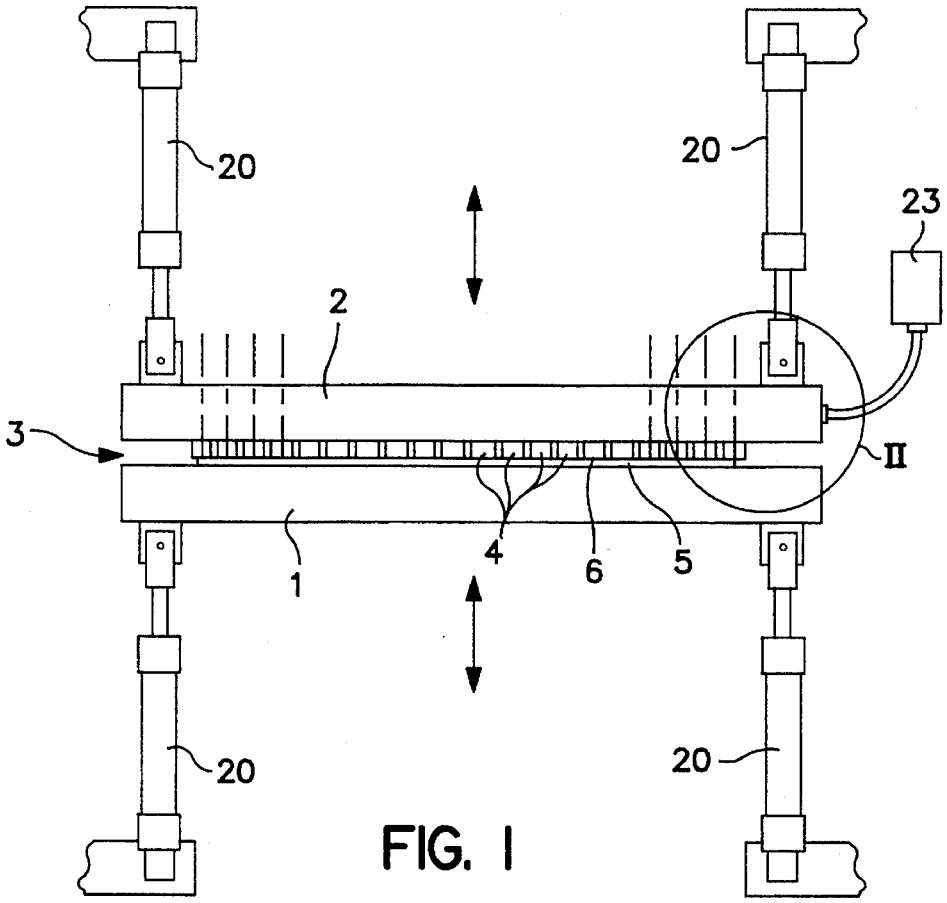
FIG. 1 a diagrammatic front view of a device according to the invention.

The device according to the invention illustrated in FIG. 1 comprises a bottom aligning rail 1 and a top aligning rail 2. The two aligning rails 1, 2 are disposed opposite one another, leaving between them a gap 3. The top aligning rail 2 has a row of aligning elements 4, which are disposed alongside one another in a longitudinal direction of the aligning rail 2 and are merely diagrammatically indicated in the view according to FIG. 1. Said aligning elements 4 extend along the aligning rail 2 substantially over a length corresponding to the width of a material web 5 which is being guided through between the aligning elements 4 and the bottom aligning rail 1. The material web 5 lies, in the view according to FIG. 1, with its underside on the bottom aligning rail 1. The aligning elements 4 come to rest with their contact surface 6 on the top side of the material web 5.

Figure 2:
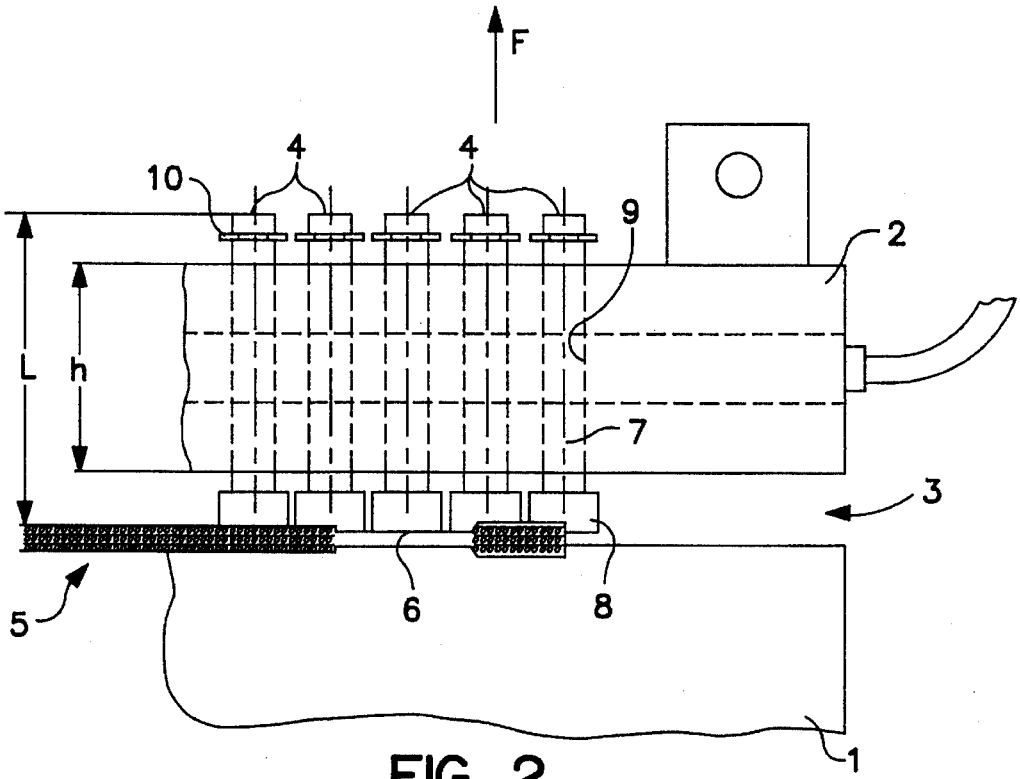
FIG. 2 an enlarged diagrammatic view of region II of the device according to FIG. 1.

In FIG. 2, region II according to FIG. 1 is shown to an enlarged scale. As is particularly evident from said view, the aligning elements 4 each have a shaft 7 and an aligning head 8 at the end of the shaft 7 directed towards the bottom aligning rail 1. Each shaft 7 of each element 4 is disposed in a recess 9 disposed in the top aligning rail 2, said recess being open in a downward direction, i.e. towards the bottom aligning rail 1, and in an upward direction. The shaft 7 of the aligning elements 4 is cylindrical, as is the recess 9. The diameter of the recess 9 is slightly larger than the diameter of the cylindrical shaft 7, with the result that the shaft 7 in the associated recess 9 of the top aligning rail 2 is freely movable with slight radial play in an axial direction relative to the shaft 7.

In the embodiment illustrated in the drawings, the length L of the shaft 7 of the aligning elements 4 is greater than the height h of the top aligning rail 2. The shaft 7 of each aligning element 4 is provided, at its top end projecting from the recess 9 of the top aligning rail 2, with a locking element 10 in the form of a Seeger circlip ring which, on the one hand, upon lifting of the top aligning rail 2 in the direction of the arrow F effects simultaneous lifting of the relevant aligning elements and, on the other hand, prevents the aligning elements 4 from falling out of the top aligning rail 2.

As is further evident from the view according to FIG. 2, the aligning foot 8 of the aligning element 4 is in the shape of a cuboid and has a bottom contact surface 6 which is to be placed flat on the material web 5, as well as (cf. view according to FIG. 4) an aligning surface 12 which is to rest against the raised pile region 13 of the material web 5 during the alignment process. The aligning surface 12 is delimited in a downward direction by an aligning edge 11. Unlike background art, the aligning surface 12 in said embodiment of the present invention is not wedge-shaped, thereby reducing the risk of an undesirable hooking into the pile of a terry toweling material.

Figure 3:
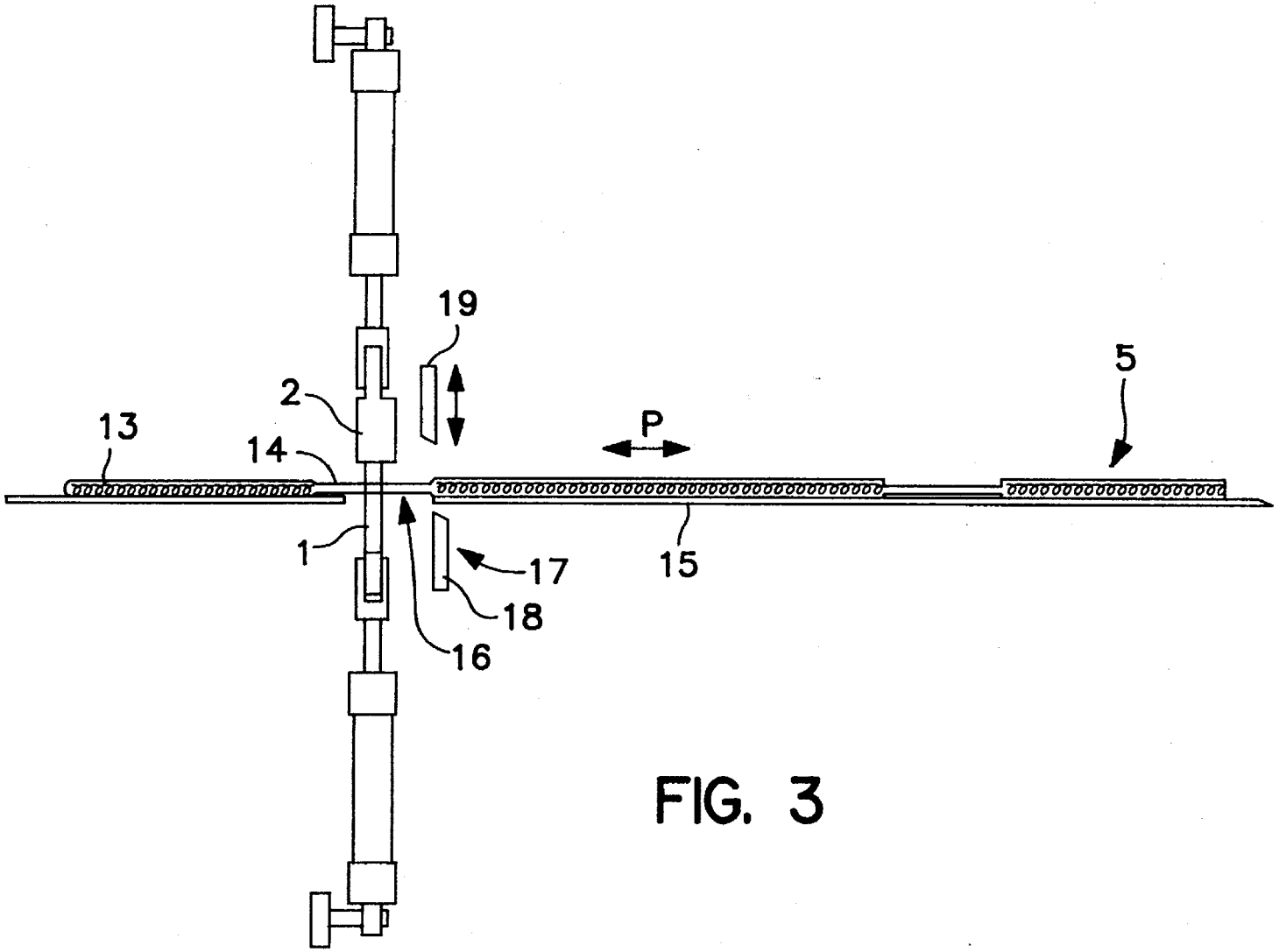
FIG. 3 a diagrammatic side view of the device according to FIG. 1.

In FIG. 3, the device according to FIGS. 1 and 2 is shown in side view. As is evident from said view, the material web 5 is conveyed on a table 15 in the direction of the arrow P. The material web 5 comprises alternating regions of different thickness, namely regions with a relatively thick pile 13 and pile-free sections 14. To manufacture, for example, hand towels of a length corresponding substantially to the region between two pile-free sections, the material web 5 after positioning and alignment by the device according to the invention is cut in each case in the region of a pile-free section 14 by means of a cutting or separating device 17. Said cutting device 17 substantially comprises a fixed bottom blade 18 and an upper blade 19 which is movable in a complementary manner relative to the bottom blade. Both the cutting and separating device 17 and the device according to the invention are disposed in the region of a recess 16 in the table 15 so that in said region both the top and bottom aligning rails 1, 2 and the top and bottom blades 18, 19 have free access to the material web 5. The width of the recess 16 substantially corresponds to the width of the material web 5.

As is particularly evident from the view according to FIG. 1, in the presently illustrated embodiment of a device according to the invention both the bottom aligning rail 1 and the top aligning rail 2 are each provided with a device for guiding and positioning the respective aligning rail 1, 2. In the presently illustrated embodiment, said device comprises one pneumatic cylinder 20 at each axial end of the aligning rails 1, 2 so that both the bottom aligning rail 1 and the top aligning rail 2 may be moved towards or lifted off one another. Upon lift-off of the top aligning rail 2, the aligning elements 4 are simultaneously raised by means of the locking elements 10 in the manner described above, thereby producing a wide open gap for passage of the material web 5 or alternatively for maintenance work on the device.

Figure 4:
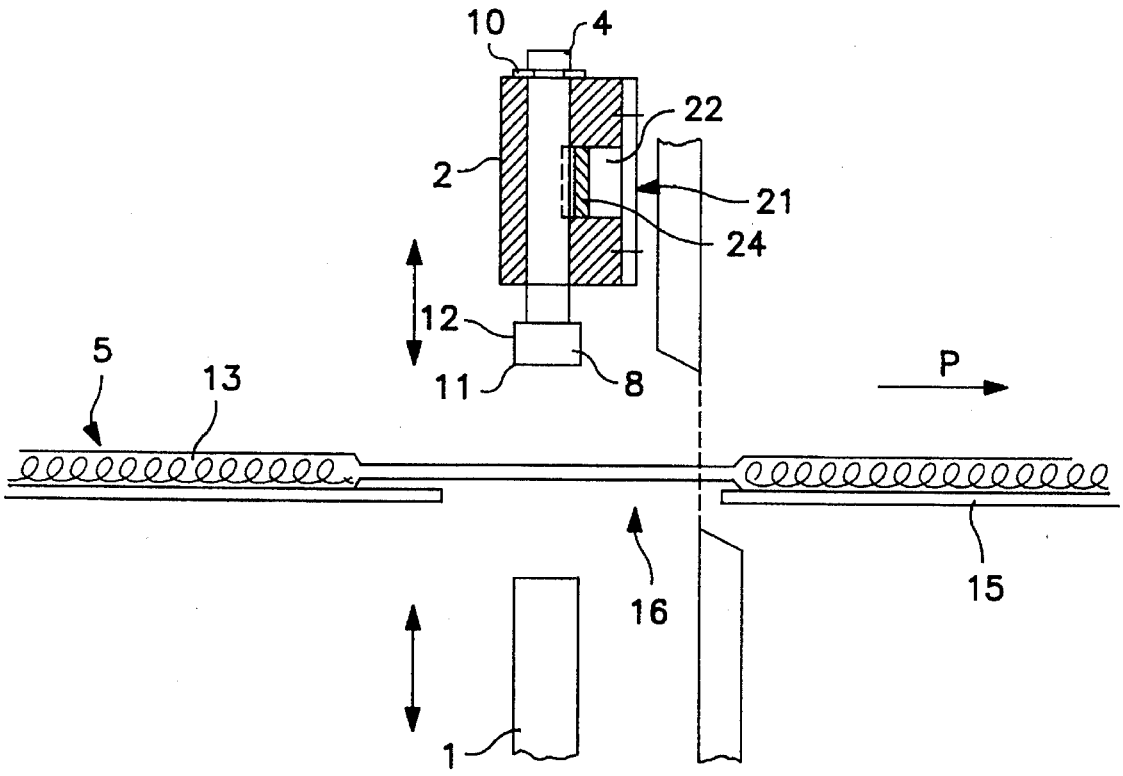
FIG. 4 a diagrammatic side view, partially in section, of the device according to the invention in open position.

FIGS. 4 to 7 each show an enlarged side view of a cutout of the device according to the invention in the region of the recess 16 of the table 15. In FIG. 4, a so-called open position is shown, in which the bottom aligning rail 1 is in its lowest position and the top aligning rail 2 is in its highest position. In said open position, further conveying of the material web 5 from one pile-free section 14 to the next may occur. In said position, the aligning element 4 illustrated by way of example is prevented by a locking element 10 from falling out of the top aligning rail 2.

Figure 5:
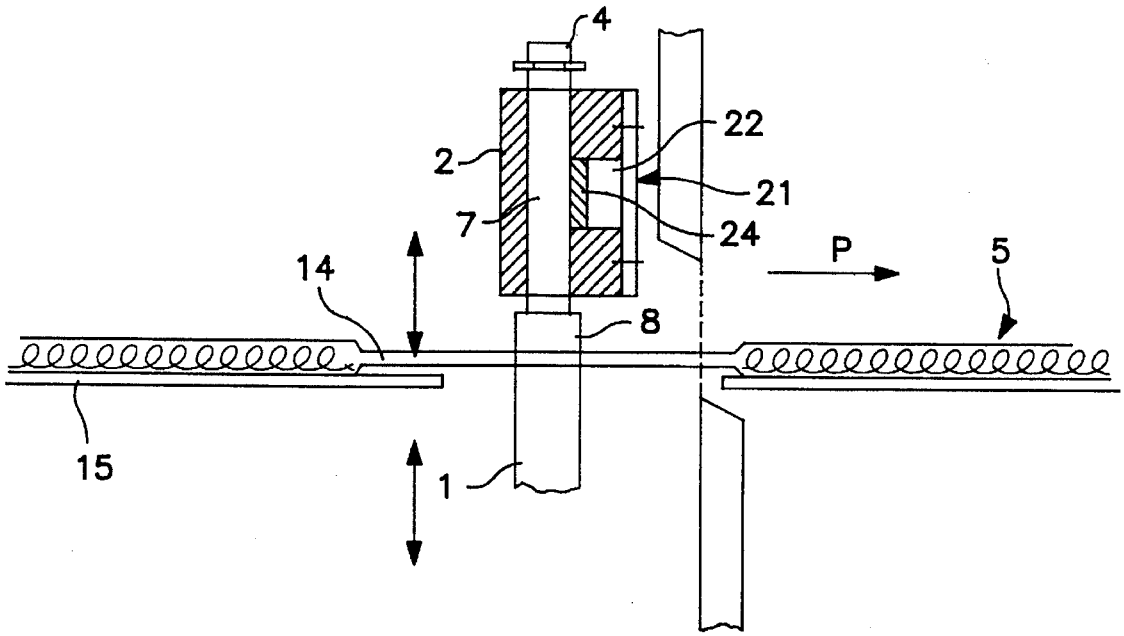
FIG. 5 a diagrammatic side view, partially in section, of the device according to the invention in clamped position, the aligning elements having been brought to rest in the pile-free region.
Figure 6:
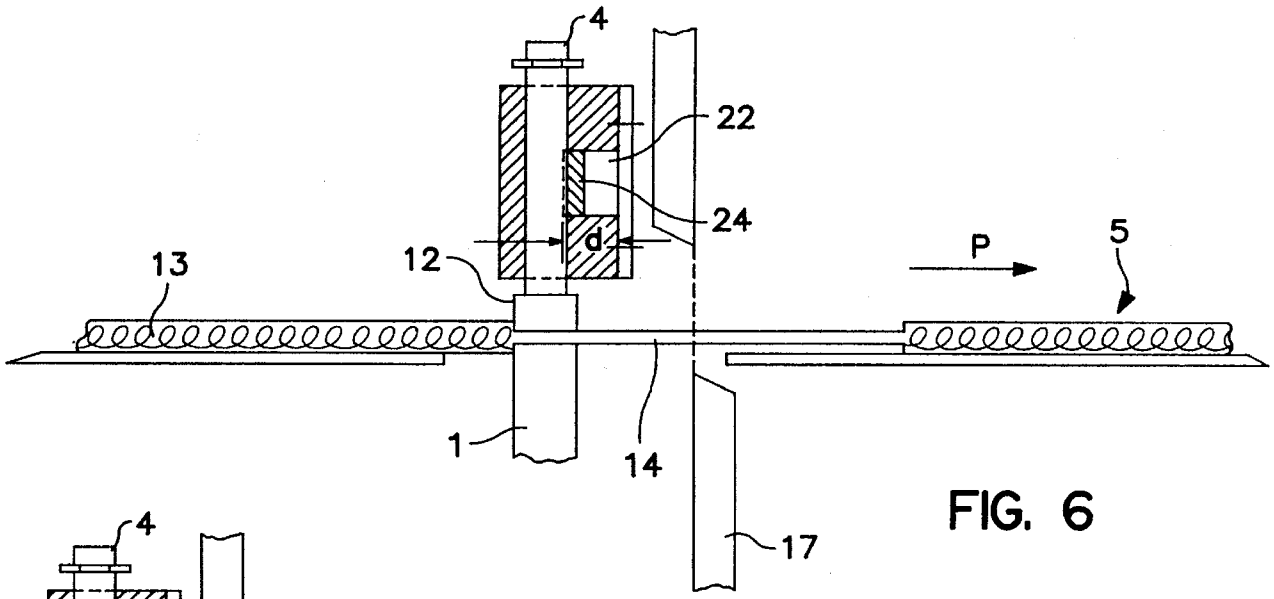
FIG. 6 a view as in FIG. 5, in which the raised pile region of the material web comes to rest against the aligning elements (end position of the alignment process)

When a pile-free section 14 of the material web 5, in which the material web is to be cut, is situated inside the device according to the invention, the bottom and top aligning rails 1, 2 are moved towards one another by the pneumatic cylinders 20 until they are in the position shown in FIG. 5. In said position, the material web lies with its pile-free region 14 on the bottom aligning rail 1. The aligning elements 4, which are supported in a freely movable manner in the top aligning rail 2, rest solely under the effect of their own weight on the surface of the material web 5 immediately above the bottom aligning rail 1. In said position, the material web 5 may easily be conveyed further in the direction of the arrow P since the forces exerted by the dead weight of the aligning-elements 4 are low. In said position shown in FIG. 5, the shaft 7 of the aligning element 4 is clamped by means of a clamping device 21, which is described in greater detail below, so that the aligning element 4 is fixed in an axial direction without, however, forces of any kind being exerted by the clamping device 21 upon the material web 5.

Upon further drawing of the material web 5 in the direction of the arrow P through the gap formed by the aligning elements 4 and the bottom aligning rail 1, the raised pile region 13 of the material web 5 pushes against the aligning surface 12 of the aligning elements 4. Contact is simultaneously effected over the entire width of the material web at all of the aligning surfaces 12 of all of the aligning elements 4, resulting in sure and reliable alignment and positioning of the material web 5 or of the pile-free region 14 of the material web 5. In said position shown in FIG. 6, cutting of the material web 5 is then effected by the diagrammatically illustrated cutting and separating device 17. The bottom aligning rail 1 and the top aligning rail 2 are then moved apart once more into the position shown in FIG. 4, whereupon the material web 5 may continue to be conveyed until the next pile-free region 14 is reached. Fixing of the aligning elements in the top aligning rail after they have been brought to rest on the material web may in principal be effected in any desired manner. It may in particulate be effected in a keyed manner, e.g. in the manner of a mechanical gripping from behind, or force-lockingly in the manner of a clamping. In an extremely simple manner, clamping may be effected, for example, by fixing each aligning element by means of a binding screw.

The clamping device 21 according to the embodiment illustrated in the drawings comprises a channel 22 which extends substantially over the entire length of the aligning rail 2, is substantially airtight and may be pressurized via a valve 23 (cf. FIG. 1) with compressed air. In the presently illustrated embodiment, a strip-like clamping element 24 made, for example, of a rubber-elastic material and extending over the entire axial length of the aligning rail 2 is disposed in the channel 22. The depth d of the channel 22 is so selected that the shafts 7 of the aligning elements 4 project at least slightly into said channel. When compressed air is admitted through the valve 23 into the channel, the clamping element 24 is pressed against the shafts 7 of the aligning elements 4 and fixes said elements in an axial direction. To release the clamping action, the channel 22 is evacuated, e.g. likewise by means of the valve device 23.

Figure 7:
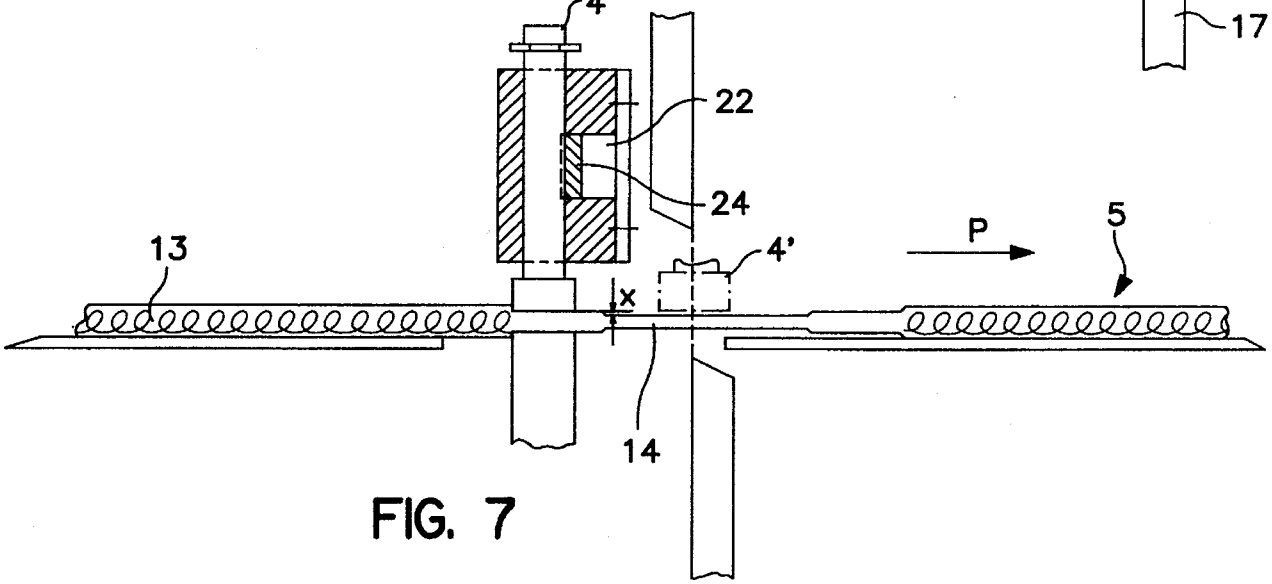
FIG. 7 a diagrammatic view illustrating the mode of operation of the device according to the invention in the case of a material web with a stepped section.

FIG. 7 illustrates the use of the device according to the invention for a material web 5, in which the pile-free woven in the section 14 incorporates steps. With such a design of material web too, the device according to the invention may be moved into position in the manner shown in FIG. 5. Subsequently, i.e. upon further conveying of the material web 5 in the direction of the arrow P, the clamped top aligning rail is lifted merely by the value of the step height x, the cross-sectional profile of the material web 5 simulated by the aligning elements 4 remaining unchanged and the top aligning rail 2, once it has reached a position just in front of the final aligning position, being merely deposited without requiring any re-adjustment to the profile of the material web. Furthermore, an undesired positioning of the material web at the step edge in the pile-free section 14 is avoided.

The invention claimed is:

1. Device for aligning material webs, which, in a longitudinal direction, have alternating regions of differing thickness, the device comprising:

a top and a bottom aligning rail disposed substantially at right angles to the material web and opposite one another with slight clearance;

a plurality of aligning elements disposed in a longitudinal direction along the top aligning rail, the aligning elements movable substantially at right angles to the plane of the material web and capable of being brought to rest on the bottom aligning rail with the material web for alignment lying in between; and means for releasably clamping the aligning elements in place;

wherein the aligning elements each have a shaft, which is guided with at least slight play in a recess of a complementary shade in the top aligning rail, and an aligning foot restable on the material web, and wherein the shaft is substantially cylindrical and has an at least slightly smaller diameter than the likewise cylindrical recess of the top aligning rail.

2. Device according to claim 1, wherein the length of the shaft of the aligning elements is greater than the height of the top aligning rail, the recess extends therethrough, and the shaft is prevented from falling out by a locking element disposed at the top end of the shaft projecting from the top aligning rail.

3. Device according to claim 2, wherein the aligning foot of the aligning element has a supporting surface for resting on the material web and an aligning surface for resting against a region of greater thickness.

4. Device according to claim 1, wherein the means for releasably clamping the aligning elements in the top aligning rail comprises mechanically gripping the aligning elements from behind.

5. Device according to claim 1, wherein the means for releasably clamping the aligning elements in the top aligning rail comprises fixing each aligning element in place with a binding screw.

6. Device according to claim 1, wherein the means for releasably clamping the aligning elements in the top aligning rail comprises a clamping mechanism responsive to fluid pressure.

7. Device according to claim 6, wherein the clamping mechanism includes at least one channel which extends substantially over the entire length of the top aligning rail, has openings towards the guide recesses of the aligning elements and has at least one clamping element responsive to fluid pressure, capable of extending through the openings to rest against the guide shafts of the aligning elements.

8. Device according to claim 7, wherein the clamping element is a substantially airtight tube, which is disposed in the channel over substantially the entire length of said channel and is responsive to fluid pressure.

9. Device according to claim 8, further comprising means for guiding and positioning at least one of the bottom and the top aligning rails relative to the plane of the material web.

10. Device according to claim 9, wherein the guiding and positioning means comprise fluid operable linear guides which are disposed at each of the two axial ends of at least one of the top and bottom aligning rails.

* * * * *